United States Patent [19]

Amboss

[11] Patent Number: 4,471,267

[45] Date of Patent: Sep. 11, 1984

[54] GRID STRUCTURE FOR CERTAIN PLURAL MODE ELECTRON GUNS

[75] Inventor: Kurt Amboss, Pacific Palisades, Calif.

[73] Assignee: Hughes Aircraft Company, El Segundo, Calif.

[21] Appl. No.: 388,289

[22] Filed: Jun. 14, 1982

[51] Int. Cl.[3] ..... H01J 25/34; H01J 1/46

[52] U.S. Cl. ..... 315/3.5; 315/3.6; 315/5.29; 315/5.37; 313/348

[58] Field of Search ..... 315/3.5, 5.29, 5.37, 315/39.63, 3.6; 313/348, 349, 240

[56] References Cited

U.S. PATENT DOCUMENTS

| | | | |
|---|---|---|---|
| 2,943,234 | 6/1960 | Zitelli | 315/5.37 X |
| 2,975,317 | 3/1961 | Susskind . | |
| 3,160,782 | 12/1964 | Rich | 315/5.37 |
| 3,812,395 | 5/1974 | Scott | 315/3.6 |
| 3,818,260 | 6/1974 | Elfe, Jr. et al. | 315/3.5 X |
| 3,843,902 | 10/1974 | Miram et al. | 313/348 X |
| 4,023,061 | 5/1977 | Berwick et al. | 313/349 |
| 4,321,505 | 3/1982 | Miram et al. | 315/3.5 X |

FOREIGN PATENT DOCUMENTS 2030750 11/1970 France .

OTHER PUBLICATIONS

Scherba, "High Efficiency Triple Mode Space Traveling-Wave Tube", Int'l Electron Devices Meeting, Dec. 1-3, 1975, Wash. D.C., IEEE Technical Digest 1975, pp. 423-425.

*Primary Examiner*—David K. Moore
*Assistant Examiner*—Vincent DeLuca
*Attorney, Agent, or Firm*—Charles D. Brown; A. W. Karambelas

[57] ABSTRACT

A cathode/grid assembly for effecting a dual power mode electron gun for use with a traveling wave tube. The conventional "shadow grid" is both electrically and mechanically isolated from the cathode. A variable voltage source is connected to the shadow grid to bias it slightly above or slightly below the cathode potential, depending on the power mode. The electron emitting surface area of the cathode is the same in both modes. By changing the bias on the shadow grid, the transverse beam temperature may be increased to compensate for the reduced space charge density of the low power mode. Thus, the diameter of the low power beam is substantially the same as the diameter of the high power beam. This ensures good beam transmission and high electron beam rf interaction in the low power mode.

9 Claims, 6 Drawing Figures

Fig. 6.
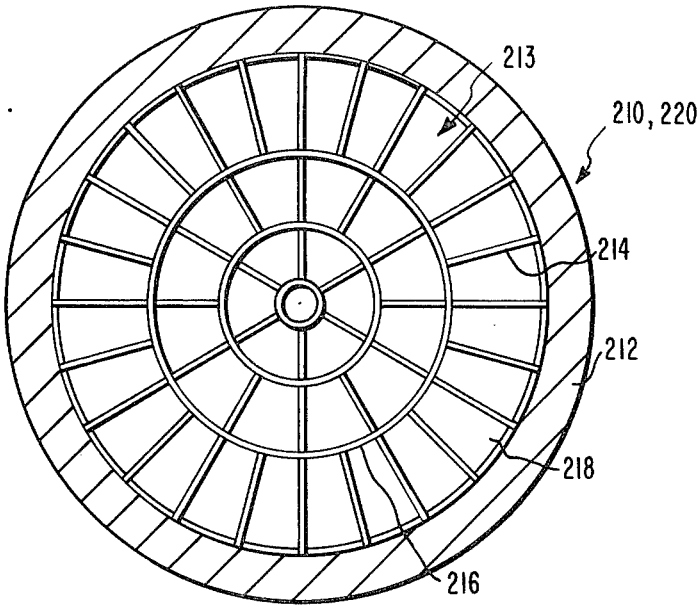
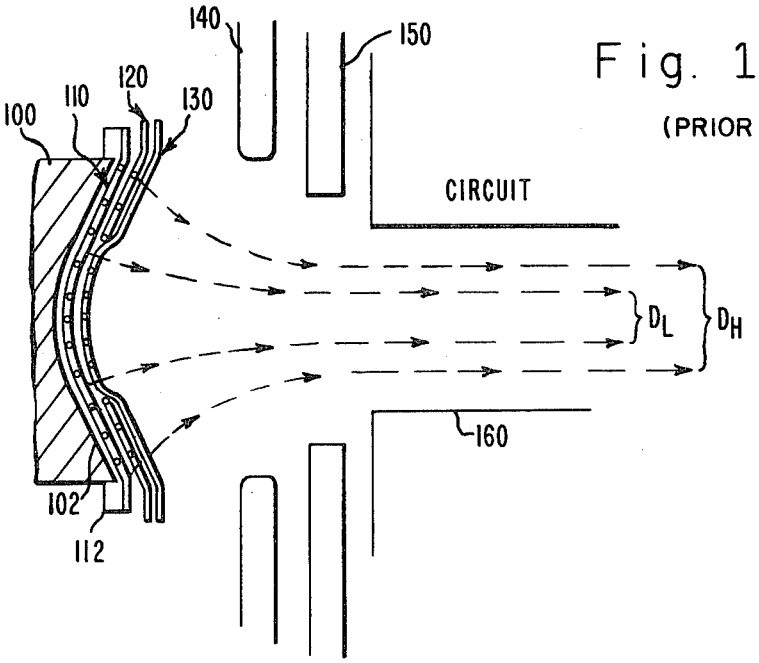
Fig. 1.
(PRIOR ART)

Fig. 3.
(PRIOR ART)
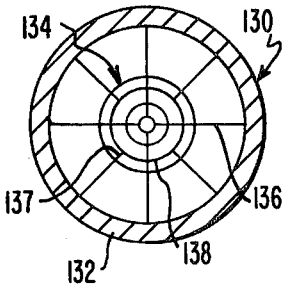
Fig. 4.
(PRIOR ART)
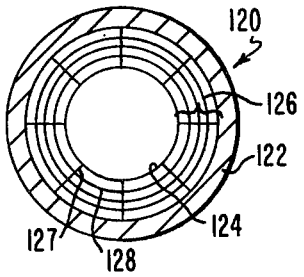
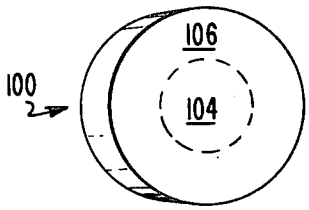
Fig. 2.

GRID STRUCTURE FOR CERTAIN PLURAL MODE ELECTRON GUNS

BACKGROUND OF THE INVENTION

1. Field of the Invention

This invention relates to electron guns for use with traveling wave tubes and, more particularly, to the grid structure of such electron guns as are focused by means of periodic-permanent-magnets.

2. Description of the Prior Art

A traveling wave tube (TWT) is a device for bringing together within the same space an electron beam and radio-frequency (rf) energy for interaction with one another to produce a desired effect. The rf energy is provided from an external source to the rf input port of the TWT. The electron beam is provided from an electron gun. A traveling wave tube (TWT) typically comprises a generally cylindrical body having a hollow axially-extending, cylindrical electron beam tube. A series of axially-extending cavities are radially positioned around the beam tube, each of the cavities having an aperture which connects or couples that cavity to the beam tube. These series of cavities are generally referred to as the circuit of the TWT. A magnetic focusing means, which is also radially positioned around the TWT circuit, produces a magnetic field, the axis of which coincides with the axis of the beam tube. The magnetic focusing means is generally either a solenoid type or a periodic-permanent-magnet (PPM) type. The magnetic field functions to exert a compressive force on the electron beam to focus it and confine it to flow within the electron beam tube in a laminar and uniform manner.

TWTs are frequently used in applications which require the TWT to be capable of alternately operating at a low power level and a high power level. The high and low power levels refer to the power level of the output power. Typically, the applications call for the high power level to require an electron beam current five times the electron beam current of the low power mode. The beam current is determined by the amount of electrons emitted from the cathode of the electron gun. To control the amount of electrons emitted from the cathode surface, electron gun grids are used. An illustration of the use of electron gun grids may be found in the device described in U.S. Pat. No. 3,812,395 issued to Scott. The electron gun is typically a Piercegun as described in "Theory and Design of Electron Beams" by J. R. Pierce, D. Van Nostrand Company, Inc., 1954.

In the device disclosed by Scott, the voltage on an electron gun control grid is varied to alternately provide a high beam current during the high power mode and a low beam current during the low power mode. However, the decreased voltage on the control grid during the low power mode causes a corresponding decrease in the amount of electrons emitted from the cathode. The decrease in the number of electrons reduces the beam space charge density. The reduced beam space charge density is thus less effective at counter-balancing the radially-inward compressive force of the magnetic field and, as a result, the electron beam collapses or defocuses from the focused, laminar state of the high power mode. Theoretically, the available low beam current should be one fifth of the amount of the available high beam current if the beam current emitted at the cathode is decreased by a factor of five. However, the low beam current that is actually available in the TWT is less because of the collapse of the beam. The collapse of the beam causes the beam to become defocused, with the result that a part of the beam intercepts the wall of the electron beam tube. For example, in a PPM-focused TWT, only approximately 50% of the theoretical amount of the low power beam current is actually transmitted through the beam tube (as compared to approximately 90% for a solenoid-focused TWT). In contrast, the transmission percentage during the high power mode is approximately 92% of the theoretical for the PPM type and 98% for the solenoid-focused type.

To alleviate the collapsing beam problem, control grids are designed and used to maintain the space charge density constant in the electron beam during the low power mode, that is, to maintain the low power mode space charge density at the level of the high power mode space charge density. This is generally accomplished by biasing the voltage on a portion of a control grid to cause a corresponding portion of the cathode electron emitting surface to be non-emitting. This produces a smaller diameter electron beam during the low power mode. The smaller diameter beam, which has a space charge density equal to that of the beam of the high power mode, does not collapse. Such a prior art control grid operation is disclosed in U.S. Pat. No. 4,023,061, issued to Berwick et al. However, this solution gives rise to problems of its own.

The control grid, of a device as disclosed in Berwick, has been biased to permit only a small diameter beam to be emitted from the cathode during the low power mode of operation. This effects a space charge density in the low power mode equal to the space charge density of the high power beam. However, the now narrow low power mode electron beam interacts poorly with the radio-frequency signal that is present at the cavity apertures of the TWT circuit. The radio-frequency signal, propagating through the cavities, creates an axially-extending cylindrical electric field that is also concentric with the hollow cylindrical beam tube. In order to amplify the radio-frequency signal, electrons in the beam tube must interact with the axial electric field. However, the electric field, due to its inherent properties, generally concentrates at the inner peripheral surface of the electron beam tube adjacent the cavity apertures. Thus, the narrow beam, which has a diameter that is much smaller than the diameter of the beam tube, interacts inefficiently with the radio-frequency signal. The efficiency of interaction, generally referred to as the electronic efficiency, is generally decreased by as much as 50% during the low power mode for the grid structures similar to that of the device shown in Berwick.

A second disadvantage of devices similar to that of Berwick results from the physical structure of the grid assembly. The control grid is comprised of two concentric grids. The radially inner grid is smaller and controls the low power mode. The radially outer grid is annular and circumscribes the radially inner grid. Together, the two grids cover a larger area and control the high power mode. Because the two grids are physically and electrically insulated from one another, the support structure of the radially inner grid must traverse the flow of emitted electrons during the high power operating mode. The support structure will thus intercept electrons in the high power mode and cause distortions in the electron optics of the high power mode.

Any prior art devices which have a low power beam of a diameter significantly less than the diameter of the high power beam will suffer from reduced electronic efficiency in the low power mode. In addition, any electron gun grid structure which has a first control grid supported concentrically with respect to a second control grid will suffer distortions in the electron optics when the beam operates in the mode wherein the radially outer control grid is activated.

SUMMARY OF THE INVENTION

It is therefore an object of the present invention to provide an electron gun having a low power electron beam with a diameter substantially equal to the diameter of the high power electron beam whereby the efficiency of interaction of the low power beam with the rf energy is comparable to the efficiency of interaction of the high power beam with the rf energy.

It is a further object of the invention to provide an electron gun having electron optics which, while operating in the high power mode, are not distorted by the presence of support members of a control grid within the flow of the electron beam.

These and other objects, features and advantages are effected by providing a novel grid structure for the electron gun. This novel grid structure comprises a shadow grid which, unlike shadow grids of the prior art, is electrically and physically insulated from the cathode of the electron gun. Because it is electrically insulated, the shadow grid can be, and is, operated at an adjustable voltage bias with respect to the cathode. The shadow grid of the invention may be biased above or below the potential of the cathode, depending on whether the electron gun is to be operated in the high power or low power mode. The control grid is also connected to an adjustable voltage source to effect a high power mode and a low power mode. The voltage biases of the two grids are separately adjusted according to the invention. Proper adjustment of the voltages, together with the fact that the control grid has the same effective area for both high and low power modes, produces an electron beam which is substantially the same diameter in both the high and low power modes. Because only a single control grid is used, instead of two concentric control grids as shown in Berwick, the electron flow is not distorted by the presence of a grid support structure within the beam flow path.

BRIEF DESCRIPTION OF THE DRAWINGS

FIG. 1 is a simplified diagrammatical view of a prior art electron gun and grid structure, depicting customary high power and low power beams;

FIG. 2 is a perspective view of a typical cathode element;

FIG. 3 shows a control grid of the prior art for controlling the low power mode of a TWT;

FIG. 4 shows a control grid which, together with the grid of FIG. 3, controls the high power mode of the TWT;

FIG. 6 is an end view of the shadow grid and the identical control grid of the present invention.

DETAILED DESCRIPTION OF THE INVENTION

Figure 5:
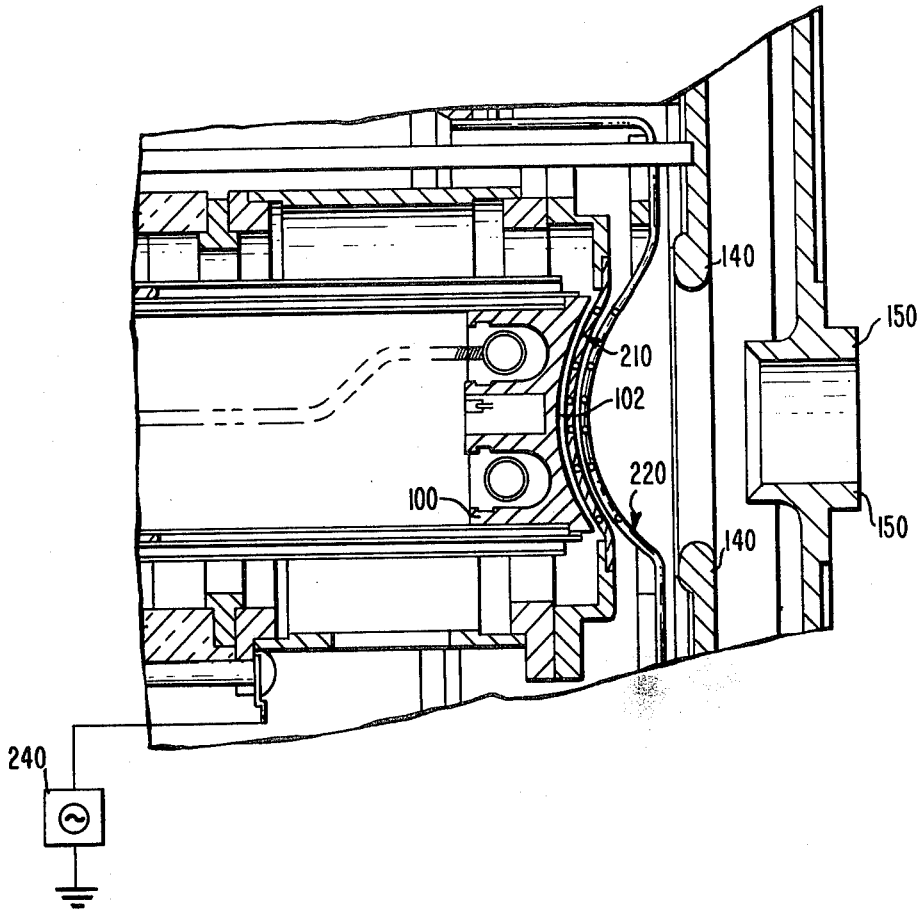
FIG. 5 is a partial cross-sectional view of the electron gun and grid structure of the present invention.

To more fully appreciate the advantages of the present invention, it is helpful to first discuss the characteristics of the structure and operation of prior art dual-mode TWTs and the associated electron guns as typified by the device shown diagrammatically in FIGS. 1–4.

The typical dual-mode electron gun is provided with an electrically heated cathode element 100 which emits electrons from a concave emission surface 102 which may be a spherical, parabolic, or hyperbolic surface of revolution. The cathode element 100 may, for example, comprise a barium-impregnated tungsten material. A grid structure, comprising a shadow grid 110 electrically connected to cathode 100 such as by connection 112, a radially outer control grid 120 and a radially inner control grid 130, is provided to control the emission of electrons from the emission surface 102. After the electrons have been emitted from the surface 102 and have passed through the grid structure, the electrons are focused into a beam configuration by a focus electrode 140 and accelerated by accelerating anode 150. Thereafter, the beam enters the TWT circuit shown as 160 in FIG. 1.

The physical characteristics of the electron beam as it enters the TWT circuit are substantially determined by the geometric configuration of the grid structure and the bias voltages applied to the grid elements, i.e., the shadow grid 110, and control grids 120 and 130. As shown in FIG. 1, the diameter $D_L$ of the low power electron beam is significantly less than the diameter $D_H$ of the high power electron beam. This difference is a direct result of the geometry of the control grids 130 and 120 shown in FIGS. 3 and 4, respectively.

Control grid 130 has a radially outer and annular mounting structure 132 and a central circular grid structure 134 supportively connected to the mounting structure 132 by radial elements 136. Control grid 120 has a radially outer and annular mounting structure 122 and a central circular aperture 124. An annular grid structure 126 is secured to the radially inner bound of mounting structure 122 and defines the aperture 124. Aperture 124 is slightly larger than grid structure 134 and grid structure 126 together with grid structure 134 occupy an area substantially equal to the entire surface area 102 of cathode 100. The area of grid structure 134 substantially corresponds in area and size to central area 104 of cathode 100 and annular grid structure 126 substantially corresponds in area and size to annular area 106 of cathode 100.

To operate the electron gun of FIG. 1 in its low power mode the cathode 100 is first heated in order to enable it to emit electrons. Control grid 130 is electrically biased positively with respect to cathode 100. This will tend to attract electrons from the central circular area 104 of cathode 100. Control grid 120 is electrically biased negatively with respect to cathode 100. This tends to inhibit the flow of electrons through the grid assembly from annular cathode surface 106. Hence, in the low power mode, the electron beam is comprised only of electrons emitted from the central circular area 104 of the cathode 100. The electron beam will thus have a relatively small diameter $D_L$ as shown in FIG. 1. Because the beam diameter $D_L$ is significantly less than the beam tube diameter defined by the walls of the TWT circuit 160, the efficiency of interaction of the electron beam with the rf energy (which is concentrated near the walls) is greatly reduced and in the vicinity of only 50% of the efficiency of interaction for the high power mode.

To operate the electron gun in its high power mode, both control grid 120 and control grid 130 are electrically biased positively with respect to cathode 100. Grid 134 thus tends to attract electrons from area 104 of the cathode 100 and grid 126 tends to attract electrons emitted from annular area 106 of cathode 100. Thus, in this high power mode, electrons are attracted by the combined grids 134 and 126 from substantially the entire emission surface 102 of cathode 100. The electron beam produced in the high power mode will have a significantly larger diameter $D_H$ as indicated in FIG. 1. This larger diameter electron beam is able to interact more efficiently with the rf energy which is concentrated near the walls of the TWT circuit 160. However, it should be noted that in the high power mode, the electrons emitted from the annular area 106 of the cathode 100, and attracted by the annular grid 126 of control grid 120, after passing through control grid 120 must pass by the support members 136 of control grid 130. The presence of support members 136 within the path of electrons attracted by control grid 120 interferes with, and creates disturbances within, the electron optical characteristics of the high power electron beam.

The shadow grid 110 of the prior art grid structure serves to protect the control grids 120 and 130 from overheating and melting, especially in the high power operating mode. Shadow grid 110 has a structure substantially identical to the combined structure of control grids 130 and 120. Thus, shadow grid 110 would have an annular radially outer mounting structure and would have a grid structure of a size and shape equal to the size and shape of the superimposed grids 134 and 126. The radially extending grid elements of shadow grid 110 would substantially align with the radially extending elements 137 of control grid 130 and with the radially extending elements 127 of control grid 120. Similarly, the circularly extending elements of shadow grid 110 would substantially align with circularly extending elements 138 and 128 of control grids 130 and 120, respectively. The shadow grid 110 is electrically connected to, and at the same electrical potential as, the cathode 100.

When operating in the high power mode, the electron beam current is on the order of four amperes. The combined area of circular and radial grid elements of control grids 120 and 130 is about ten percent of the electron emission surface 102. Thus, approximately ten percent of the beam current, or 0.4 amperes, would be intercepted by the two control grids. Because the control grids, in the high power mode, operate at about 300 volts above the potential of the cathode, the power that would have to be dissipated by the two control grids is on the order of 120 watts. This amount of power is not readily dissipated by the control grids and they would quickly overheat and melt. By interposing shadow grid 110 between the electron emission surface 102 and the control grids 120 and 130, the emission of electrons from the cathode surface 102, directly opposite the radial elements and circular elements of the shadow grid, is suppressed by the low potential of the shadow grid 110. Hence, only minimal electrons are intercepted by the radial and circular elements of the control grids. The shadow grid 110 will suppress the ten percent of the electron beam current (i.e., 0.4 amperes) and thus shield the control grids 120 and 130. Since the shadow grid 110 is at zero volts potential with respect to the electron emission surface 102 it is not required to dissipate any power.

Having described the operation and characteristics of prior art electron guns and their grid structure, the characteristics, features and advantages of the grid structure of the present invention may now readily be perceived as described below with reference to FIGS. 5 and 6.

The electron gun of FIG. 5 is substantially identical to the electron gun of FIG. 1 with the exception of the novel structure of the cathode and grid elements. The electron gun of FIG. 5 has a heated cathode 100 having an electron emission surface 102. A grid assembly controls the flow of emitted electrons toward a focus electrode 140 and toward an accelerating anode 150. The electron beam then enters the TWT circuit. The novel grid structrure of the invention is distinguished from the grid structure used in dual mode TWTs of the prior art in several respects.

The shadow grid 210 of the present invention is shown in FIG. 6. It comprises an annular mounting member 212 and an electrically conductive interior grid structure 213. The grid structure 213 is formed by a plurality of intersecting radial elements 214 and circular elements 216. The elements 214 and 216 may typically be a molybdenum material and intersect to form a plurality of apertures 218 which are roughly 0.100 inches by 0.060 inches. The shadow grid 210 is mounted to be in both electrical and mechanical isolation from the cathode 100. Thus, the shadow grid 210 can be electrically biased, such as by a variable voltage source 240, to operate at an electrical potential different from that of the cathode 100 and either above or below the potential of the cathode 100 depending upon the mode of operation of the TWT. The shadow grid 210 performs the same function of shielding the control grid (220 in FIG. 5) as does shadow grid 110 of FIG. 1. The distinguishing features of shadow grid 210 are that it is electrically and mechanically insulated from cathode 100 and it is operated at a voltage other than that of the cathode. The shadow grid 110 may typically be axially spaced from electron emission surface 102 by about 0.003 inches (0.0762 mm).

The control grid 220 is substantially identical to shadow grid 210 except its mounting member may be broader than that of shadow grid 210. The grid area of control grid 220 is substantially the same size as the grid area 213 of shadow grid 210. Further, the radial grid elements and circular grid elements of control grid 220 are aligned with the radial grid elements 214 and circular grid elements 216, respectively, of shadow grid 210. Thus, shadow grid 210 can perform its protective shadow function and shield control grid 220 just as shadow grid 110 shields control grids 120 and 130. The word "aligned" when used with respect to the radial and circular grid elements of shadow grid 210 and control grid 220 means the elements are aligned parallel to the localized flow of electrons within the beam, such that control grid 220 does not intercept electrons.

It is well known that when a grid coincides in position and voltage with an equipotential surface of an electron beam, the electron trajectories are not disturbed by the presence of the grid (except for those electrons which are intercepted by the grid). The grid is effectively "invisible" to the electron beam. (See "An Ultra-Laminar Tetrode Gun for High Duty Cycle Applications" by Richard True, IEEE IEDM, pgs. 286–289, 1979). By running the shadow grid 210 slightly positive with respect to the cathode 100 and positioning the shadow grid according to the above principle, a high quality beam can be obtained. Both the shadow grid 210 and the control grid 220 will appear to be invisible to the beam. The electron gun will behave essentially like an ungridded gun. This high power mode of operation should therefore produce an excellently focused laminar beam. Since the shadow grid is operated at a relatively low voltage, heating by the interception of beam current is not significant.

In the low power mode the shadow grid 210 is operated slightly negatively with respect to the cathode 100. The position of the shadow grid with respect to the cathode 100 is not changed. The shadow grid 210 is thus no longer located so as to be "invisible". The slightly negative bias of the shadow grid reduces the emitted electron current. Since the diameters of the grids have not changed, the space charge density of the beam has been reduced. However, the slightly negative bias of the shadow grid 210 has also disrupted the path of electrons passing through the grid. Instead of following a highly laminar path, the negative bias of the shadow grid 210 imparts a large transverse velocity component to the emitted electrons. This increase in the beam's transverse kinetic energy effectively raises the "transverse beam temperature". This increase in transverse beam temperature offsets, to some extent, the decrease in space charge density, thereby countering the tendency of the magnetic field to compress the electron beam. By raising the transverse beam temperature of the low power beam sufficiently to counteract the decrease in space charge density, it is possible to maintain the diameter of the low power beam substantially equal to the diameter of the high power beam. This is in accord with Herrmann's optical theory of thermal velocity effects as stated in "Optical Theory of Thermal Velocity Effects in Cylindrical Beams", by G. Herrmann in Journal of Applied Physics, Vol. 29, p. 127, 1958.

The thermal beam equilibrium radius R (the "Herrmann radius") in the magnetic field is related to the Brillouin radius $R_{BR}$, the beam temperature T, the magnetic focusing field B and its value at the cathode $B_c$ by the equation:

$$\bar{R} = R_{BR}\left[\tfrac{1}{2} + \tfrac{1}{2}\left(\frac{B_c^2 r_c^4}{B^2 R_{BR}^4} + \frac{2\,kmTr_c^2}{e^2B^2R_{BR}^4}\right)^{\frac{1}{2}}\right]^{\frac{1}{2}} \quad (1)$$

where k, e and m are respectively the Boltzman constant and the charge and mass of an electron. The radius of the cathode of the electron gun is $r_c$.

The term $R_{BR}$ accounts for the space charge effect since:

$$B^2 R_{BR}^2 = \frac{\sqrt{2}\,P\Phi}{\pi\epsilon_o(e/m)^{3/2}} \quad (2)$$

where P is the beam perveance, $\epsilon_o$ is the permittivity of free space ($8.855\times10^{-12}$ farads/meter) and $\Phi$ is the beam voltage. Equations (1) and (2) are from "Verification and Use of Herrmann's Optical Theory of Thermal Velocity Effects in Electron Beams in the Low Perveance Regime" by K. Amboss, IEEE Trans. ED, Vol. 11, p. 479 (1964).

For a typical dual mode X-band TWT the perveance will change from $P=1.0\mu P$ in the high power mode to $P=0.2\mu P$ in the low power mode. Other typical tube parameters for high an low power modes are set out in Table 1.

TABLE 1

| Parameter | Power Mode High | Power Mode Low |
|---|---|---|
| Radius of Curvature of Cathode (in.) | 0.684(1.73736 cm) | 0.684 |
| Radius of Cathode (in.) | 0.311(.7899 cm) | 0.311 |
| Semiangle of Convergence (degrees) | 27 | 27 |
| Radius of Pole Piece (in.) | 0.1(.254 cm) | 0.1 |
| Voltage (volts) | 24,500 | 24,500 |
| Maximum Field (Gauss) | 2250 | 2250 |
| Cathode Field (Gauss) | 3.937 | 3.937 |
| Micropervs $\left[\frac{\text{amps}\times10^6}{(\text{volts})^{3/2}}\right]$ | 1.0 | 0.2 |
| Temperature of Cathode (degrees K) | 1,400 | 18,000* |
| First Anode Volts (volts) | 24,500 | 24,500 |
| Magnetic Field Period (in.) | 0.985(2.5019 cm) | 0.985 |

*effective transverse temperature

Using the values of Table 1 to solve equations (1) and (2) leads to the results of Table 2. In Table 2 Confined Radius is R with T set to zero and Temperature Radius is R with $B_c$ set to zero.

TABLE 2

| Parameter | | High | Low |
|---|---|---|---|
| Brillouin Radius | (in.) | 0.0227 | 0.0102 |
| | (cm) | 0.057658 | 0.02591 |
| Confined Radius | (in.) | 0.0243 | 0.0164 |
| | (cm) | 0.061722 | 0.041656 |
| Temperature Radius | (in.) | 0.0235 | 0.0238 |
| | (cm) | 0.05969 | 0.060452 |
| Total Radius | (in.) | 0.0249 | 0.0247 |
| | (cm) | 0.063246 | 0.062728 |

Table 2 shows that substantially the same total beam radius is obtained for the high power mode with P=1.0 and T=1,400 degrees K (the actual operating temperature of the cathode) and for the low power mode with P=0.2 and T=18,000 degrees K. This analytical approach was verified by modifying a standard electron gun design #162 CGH-P to allow the shadow grid 210 to be operated at small positive and negative voltages (±50v) with respect to the cathode 100. The modified gun was mounted on a standard 8725 TWT body manufactured by Hughes Aircraft Company.

For the high power mode the TWT was focused with the shadow grid 210 at 10 volts positive with respect to the cathode which was at −25,000 V. The control grid 220 was set to −24,699 volts (i.e., 301 V positive with respect to the cathode) and produced a normal operating current of four amps. The best beam transmission obtained was 82.5%. This value is comparable to the transmission obtained in production tubes using unmodified guns which have the shadow grid electrically connected to the cathode. RF power of 15 KW was obtained across the band from 9.7 to 9.9 GHz.

For the low power mode the beam current was reduced to one ampere by reducing the voltage on shadow grid 210 to −25,040 V, i.e., 40 volts negative with respect to the cathode. The control grid 220 was set to −24,885 (i.e., 115 V positive with respect to the cathode). The beam transmission obtained was 90%, and the rf transmission was 88%. These figures compare favorably to the figures of prior art PPM type TWTs which show a high power beam transmission of 92% and a low power mode beam transmission of only 50%.

There has thus been provided a dual mode electron gun having only two grids, a shadow grid and a control grid. By connecting the shadow grid to a variable voltage source the shadow grid may be operated at a voltage level slightly above or below the voltage level of the cathode. In the low power mode, the shadow grid is operated slightly negative (40 volts negative) with respect to the cathode, thereby increasing the transverse beam temperature and compensating for the decreased space charge density. The beam thus is able to maintain its diameter against the compressive force of the magnetic fields. By virtue of the teachings of the invention, relatively minor changes can be made to a standard electron gun (i.e., a single mode gun) to permit dual mode operation of the gun. First, the shadow grid must be isolated from the cathode to permit it to operate at a voltage other than that of the cathode, i.e., at the voltage provided by a variable voltage source. Second, the voltages on the shadow grid and control grid are adjusted to achieve the required increase in transverse beam temperature. It is believed that with appropriate adjustment of voltage bias and spacing, multiple "shadow grids" could be used to effect a multiple mode (i.e., three or more power mode) electron gun.

While the invention has been described with particular reference to FIGS. 1–6, the FIGURES and the specification, as well as the specific examples employed, are for purposes of illustration and discussion only. Many changes in structure and material could be made by one of ordinary skill in the art without departing from the spirit and scope of the invention. The scope of the invention is intended to be limited only as set forth in the appended claims.

What is claimed is:

1. In an electron gun intended for use with a periodic-permanent-magnet focused traveling wave tube having a high power mode of operation wherein the electron beam has a first space charge density and a low power mode of operation wherein said electron beam has a second and lower space charge density, an improved cathode and grid assembly comprising:

a cathode having an emitting surface for emitting electrons to form an electron beam having a longitudinal axis;

a control grid mounted in axially spaced apart relation with said cathode;

means mounted intermediate said cathode and said control grid for increasing the transverse beam temperature of said low power mode electron beam;

whereby said transverse beam temperature may be increased to a level sufficient to compensate for said lower space charge density of said low power mode, thereby producing a low power electron beam substantially equal in diameter to the diameter of the high power mode electron beam.

2. The improvement according to claim 1 wherein said means for increasing the transverse beam temperature comprises:

a shadow grid mounted in a longitudinally spaced relation with said emitting surface, said shadow grid further being both electrically and mechanically isolated from said emitting surface;

biasing means coupled to said shadow grid for biasing said shadow grid at an electrical potential selectively above or below the electrical potential of said emitting surface.

3. The improvement according to claim 2 wherein said biasing means comprises a variable voltage source.

4. The improvement according to claim 2 wherein the perimeter of said cathode substantially coincides with the perimeter of said shadow grid and said control grid.

5. In an electron gun intended for use with a periodic-permanent-magnet focused traveling wave tube having a high power mode and a low power mode of operation, an improved cathode and grid assembly comprising:

a cathode having an emitting surface for emitting electrons to form an electron beam having a longitudinal axis;

a shadow grid mounted in a longitudinally spaced relation with said emitting surface, said shadow grid further being both electrically and mechanically isolated from said emitting surface;

first biasing means coupled to said shadow grid for biasing said shadow grid at an electrical potential selectively above or below the electrical potential of said emitting surface;

a control grid mounted in longitudinally spaced relation with said shadow grid and on the opposite side of said shadow grid as said emitting surface;

second biasing means coupled to said control grid for adjusting the electrical potential of said control grid;

whereby the electrical potential of said shadow grid and said control grid may be adjusted to cause said electron gun to produce an electron beam which has a diameter in its low power mode substantially equal to its diameter in its high power mode.

6. The improved cathode and grid assembly according to claim 5 wherein the perimeter of said cathode substantially coincides with the perimeter of said shadow grid and the perimeter of said control grid.

7. A method for converting a standard periodic-permanent-magnet focused Pierce-type electron gun having a cathode, a conventional shadow grid and a control grid, into an electron gun capable of alternate operation at a high power mode and a low power mode, comprising the steps of:

electrically and mechanically isolating said shadow grid from said cathode;

coupling a first adjustable electrical biasing means to said shadow grid;

coupling a second adjustable electrical biasing means to said control grid;

whereby said shadow grid may be biased above or below the electrical potential of said cathode and said control grid may be biased to produce a low power mode electron beam having a diameter substantially equal to the diameter of the high power mode electron beam.

8. In an electron gun intended for use with a periodic-permanent-magnet focused traveling wave tube having a high power mode and a low power mode of operation, an improved cathode and grid assembly comprising:

a cathode having an emitting surface for emitting electrons to form an electron beam having a longitudinal axis;

a shadow grid mounted in a longitudinally spaced relation with said emitting surface, said shadow grid further being both electrically and mechanically isolated from said emitting surface; and a single control grid mounted in longitudinally spaced relation with said shadow grid and on the opposite side of said shadow grid as said emitting surface, said single control grid being substantially coextensive with said shadow grid.

9. The improvement according to claim 8 further comprising:

a first adjustable electrical biasing means coupled to said shadow grid; and a second adjustable electrical biasing means coupled to said control grid;

whereby the electrical bias of said shadow grid and said control grid may be adjusted to permit plural power mode operation of said electron gun.

* * * * *